United States Patent [19]

Arcilesi

[11] 4,450,191

[45] May 22, 1984

[54] AMMONIUM IONS USED AS ELECTROLESS COPPER PLATING RATE CONTROLLER

[75] Inventor: Donald A. Arcilesi, Mt. Clemens, Mich.

[73] Assignee: OMI International Corporation, Warren, Mich.

[21] Appl. No.: 413,225

[22] Filed: Sep. 2, 1982

[51] Int. Cl.[3] ..... C23C 3/02

[52] U.S. Cl. ..... 427/443.1; 106/1.23; 106/1.26; 427/305; 427/437

[58] Field of Search ..... 427/437, 443.1, 305; 106/1.23, 1.26

[56] References Cited

U.S. PATENT DOCUMENTS

| | | | |
|---|---|---|---|
| 3,011,920 | 12/1961 | Shipley | 106/1.11 |
| 3,257,215 | 6/1966 | Schneble . | |
| 3,259,559 | 7/1966 | Schneble . | |
| 3,329,512 | 7/1967 | Shipley . | |
| 3,377,174 | 4/1968 | Torigai . | |
| 3,532,518 | 10/1970 | D'Ohavio . | |
| 3,615,736 | 10/1971 | Stone . | |
| 3,622,370 | 11/1971 | D'Ohavio | 204/30 |
| 3,961,109 | 6/1976 | Kremer | 427/304 |
| 3,962,497 | 6/1976 | Doty | 427/306 |
| 4,153,746 | 5/1979 | Kilthan | 106/1.11 |
| 4,204,013 | 5/1980 | Arcilesi | 427/304 |

OTHER PUBLICATIONS

Arcilesi, "Improvements in Electroless Copper for Automotive Plastic Trim", Plating, & Surface Finishing, p. 90, Jun. 1981.

Saybestre, "Stabilizing Electroless Copper Solutions" Plating, pp. 563–566, Jun. 1972.

Saybestre, "Electroless Copper Plating" 46th Annual Technical Proceedings, American Electroplaters' Society, pp. 264–276.

*Primary Examiner*—John D. Smith

*Attorney, Agent, or Firm*—Richard P. Mueller

[57] ABSTRACT

A process and composition for use in electroless copper plating where the process includes contacting a substrate with a solution comprising copper, a complexing agent, a reducing agent, and a pH adjuster. A stabilizer may also be used. The improvement of the present invention includes contacting the substrate with a solution further comprising ammonium ions present in an amount effective to function as a plating rate controller. The improved solution is relatively stable, easy to control, and is of versatile use.

12 Claims, No Drawings

AMMONIUM IONS USED AS ELECTROLESS COPPER PLATING RATE CONTROLLER

BACKGROUND OF THE INVENTION

A variety of methods have heretofore been used or proposed for use in applying metallic platings to all or portions of the surfaces of polymeric plastic parts. Such processes conventionally comprise a plurality of sequential pre-treatment steps to render the plastic substrate receptive to the application of electroless plating whereafter the plated part can be processed through conventional electroplating operations to apply one or a plurality of supplemental metallic platings over all or selected portions of the plastic substrate. Conventionally, the pre-treatment steps employed include a cleaning or series of cleaning steps, if necessary, to remove surface films or contaminating substances, followed thereafter by an aqueous acidic etching step employing a hexavalent chromium solution to render the plastic hydrophillic and create bonding sites to achieve a desired surface roughness or texture enhancing a mechanical interlock between the substrate and the metallic plating to be applied thereover. The etched substrate is then subjected to one or a plurality of rinse treatments to extract and remove any residual hexavalent chromium ions on the surfaces of the substrate which may also include a neutralization step including reducing agents to substantially convert any residual hexavalent chromium ions to the trivalent steps. The rinsed etched substrate is thereafter typically subjected to an activation treatment in an aqueous acidic solution containing a tin-palladium complex to form active sites on the surface of the substrate followed by one or more rinsing steps after which the activated surface is typically subjected to an accelerating treatment in an aqueous solution to extract any residual tin constituents or compounds on the surface of the substrate and thereby expose active catalytic sites. The accelerated plastic part is again water rinsed and thereafter is subjected to an electroless plating operation of any of the types known in the art to apply a metallic plate such as copper, nickel, or cobalt over all or certain selected areas thereof whereafter the part is rinsed and thereafter is subjected to conventional electroplating operations.

Typical of such plastic plating processes are those described in U.S. Pat. Nos. 3,011,920; 3,257,215; 3,259,559; 3,310,430; 3,329,512; 3,377,174; 3,532,518; 3,615,736; 3,622,370; 3,961,109; 3,962,497; 4,153,746; and 4,204,013; as well as those described in articles entitled "Stabilizing Electroless Copper Solutions", by E. B. Saubestre, Plating, June, 1972; and "Improvements in Electroless Copper for Automotive Plastic Trim", by D. A. Arcilesi, Plating and Surface Finishing, June, 1981; as well as those described in my copending application entitled "Metallic Impurity Control for Electroless Copper Plating", Ser. No. 314,280 filed Oct. 23, 1981; to which reference is made for further details of the processes, and the disclosures of which are hereby incorporated by reference. The present invention is believed to be applicable to processes of the foregoing type and is specifically directed to an improved electroless copper plating rate controller which provides benefits and advantages heretofore unattainable in accordance with prior art practices.

In a conventional electroless copper plating bath, the various components of the plating bath are aqueous concentrates, and include such basic components as copper concentrate, a metal solubilizer or complexer, a reducing agent, and a pH adjuster. In addition, a stabilizer and a plating rate controller may also be used. Most of the early electroless copper processes used cupric sulfate as the source of metal ions. However, more recent processes employ cupric chloride, which is more soluble than copper sulfate. Due to the high alkalinity of present state-of-the-art autocatalytic copper baths, a complexer is needed to prevent the precipitation of copper as its hydroxide. Substituted aliphatic amine chelating agents such as ethylenediaminetetraacetic acid tetrasodium salt ($Na_4EDTA$) have been found to be effective copper solubilizers over relatively broad pH and temperature ranges, and therefore are widely used. Formaldehyde (such as a 37 percent solution stabilized with 10 percent methanol) is believed to be the major reducing agent used in high volume production installations. Sodium hydroxide solutions (50 percent caustic soda for example) are used to maintain the pH at from about 11 to 13, depending on the specific additive system being used. It is important to control the pH carefully because the ability of formaldehyde to reduce copper increases dramatically with increasing pH.

Because copper is autocatalytic, random copper particles that form in solution would be plated indefinitely if they were not stabilized. An electroless copper stabilizer causes the plating rate at a given copper surface to diminish as plating time increases. Among the reasons for using a stabilizer are to limit metal deposition to the work being plated and to prevent solution decomposition. If no stabilizer were present, copper particles or solid impurities falling to the bottom of the plating tank would be plated. Furthermore, they would continue to plate in an uncontrolled manner until the solution decomposed due to massive tank plating. Some stabilizers can also improve the luster and/or ductility of copper deposits.

Electroless copper stabilizers are compounds that cause the formation of non-catalytic thin films on the surface of electroless copper deposits that remain in the solution for extended periods of time. Heterocyclic organic sulfur compounds are believed to be the most widely used electroless copper stabilizers. They have replaced numerous other organic and inorganic sulfur compounds, including colloidal sulfur. Very high molecular weight organic polymers such as gelatin, hydroxy alkyl starches, cellulose ethers, polyamides, polyvinyl alcohol, and polyalkylene oxides have also been used to encapsulate copper particles.

Rate controllers such as cyanide iodide, or other related organic compounds, and nonsulfur containing nitrogen heterocyclics such as bipyridyls and phenanthrolines, reduce the activity of electroless copper processes. Rate controllers are used to reduce the rate of the electroless copper reduction reaction, thereby regulating the copper plating thickness per unit time. Rate controllers also accommodate stabilizers and help them function better by giving them more time to form non-catalytic coatings over the active plating sites in view of the decreased plating rate. It is known that the reduction of cupric ions to copper metal is a two-step process in which the divalent copper is first reduced to monovalent copper (the rate determining step in the absence of rate controllers and stabilizers), and then to copper metal. In view of this two-step reduction, and given that rate controllers are generally inorganic or organic substances which form more stable complexes with monovalent copper than with divalent copper, it follows that rate controllers lower the plating rate by retarding the conversion of monovalent copper to copper metal. With regard to conventional rate controllers such as cyanide, for example, very small amounts of cyanide ions can reduce the plating rate significantly, but substantial increases in the amount of cyanide ions over such small amounts will generally not cause any significant additional rate change. Therefore, although cyanide compounds are generally effective over a wide concentration range and are relatively easy to control, they provide non-linear control, which is often undesirable because intermediate plating rates between the high and low values cannot be effectively achieved by varying the concentration of the cyanide compounds.

If no rate controller was used, it would be virtually impossible, at least in most commercial applications, to achieve adequate filtration of the plating solutions to remove particles that would form at a high rate and subsequently cause the decomposition of the plating solution due to massive copper nucleation throughout the solution. In addition to providing a controlled electroless copper reaction rate, rate controllers can also improve the luster and ductility of copper deposits by acting as grain refiners to produce smoother, brighter, less porous, denser deposits.

At the present time, it is believed that the most widely used rate controllers are cyanide or organic derivatives of cyanide, all of which are toxic. Thus a continuing problem associated with the use of such cyanide-type rate controllers has been the control and/or care necessary in the handling and use of such materials and resulting electroless copper plating solutions. Likewise, such cyanide-type rate controllers and resulting electroless copper plating solutions require special consideration as far as environmental factors are concerned, especially with regard to waste treatment and disposal. Accordingly, a need existed for a non-toxic, environmentally acceptable rate controller for use in electroless copper plating solutions and processes, which rate controller would also be stable, easy to control, and adapted for use with current conventional electroless copper plating systems.

SUMMARY OF THE INVENTION

In accordance with the present invention, it has unexpectedly been found that ammonium ions, in effective amounts, can function as a rate controller, as defined hereinabove, in conventional electroless copper plating solutions and processes. The present invention is useful in processes for applying electroless copper plating to a substrate where the process includes contacting the substrate with a conventional solution which comprises copper, a complexing agent, a reducing agent, and a pH adjuster. Such a conventional solution may further comprise a stabilizer. In the practice of the present invention, such solutions would further comprise ammonium ions. The ammonium ions used in the present invention would be added so as to be present in an amount effective to function as a plating rate controller, that is, in an amount sufficient to decrease and control the plating rate or copper deposition rate of the electroless copper plating process. Ammonium ion concentrations in the range of from about 50 to about 600 mg/L are suitable in solutions of the present invention, with from about 250 to about 350 mg/L being preferred, and about 275 mg/L being typical to furnish a plating rate of about 35 micro inches per 10 minutes. The solutions may be operated in a temperature range of from about 70° F. to about 160° F. and at pH values of from about 11 to about 13. Negligible ammonium ion concentrations, i.e., those in which insufficient ammonium ions are present to allow the same to function as an effective plating rate controller, are not intended to be within the scope of the present invention. The ammonium ions may be added to the electroless copper plating solution in the form of an aqueous concentrate of an ammonium compound such as ammonium hydroxide, ammonium sulfate, ammonium chloride, or the like. Also, gaseous ammonia can be bubbled into the solution. It has been found that the plating rate of the electroless copper plating process can be controlled (in a relatively linear manner) by the amount of ammonium ions added to the process. Furthermore, it has been found that the ammonium ions improve the appearance of the resultant copper deposits and function as a grain refiner to produce smoother, brighter, less porous, denser deposits. Thus, by simply observing the appearance of the resultant copper plate, a plater can easily control the plating rate of the electroless copper process by controlling the ammonium ion concentration, which itself is a relatively simple task.

As used herein, the term "copper" is meant to include copper ions, copper salts, and other forms the copper may take in the electroless copper plating solutions used in accordance with the present invention.

Additional benefits and advantages of the present invention will become apparent upon a reading of the detailed description of the preferred embodiments taken in conjunction with the accompanying examples.

DESCRIPTION OF THE PREFERRED EMBODIMENTS

The process of the present invention is suitable for use with any of the various platable plastic or polymeric plastics including acrylonitrile-butadiene-styrene (ABS), polyaryl ethers, polyphenylene oxide, nylon, and the like. Such substrates are typically cleaned and then rinsed in a manner well known in the art (such as employing an aqueous alkali soak solution followed by contact in an organic solvent medium which may comprise either a single-phase system or an aqueous-organic solvent emulsion, followed by a thorough water rinsing), and as typically referred to in U.S. Pat. No. 4,204,013, the teachings of which are hereby incorporated by reference. The part is then subjected to an etching treatment in an aqueous acid solution containing hexavalent chromium ions and acid, such as sulfuric acid, to effect an etching of the surface thereof. The specific concentration of the etching solution, the temperature, and the duration of the treatment will vary depending upon the specific type of plastic substrate and the parameters of the etching step are, accordingly, dictated by procedures well know and practiced in the art.

Following the etching step, the etched polymeric substrate is subjected to one or more cold wate rinses and may additionally include a neutralization step employing an aqueous solution containing a reducing agent to effect a reduction of any residual contaminating hexavalent chromium ions to the trivalent state. A typical neutralization treatment is described in U.S. Pat. No. 3,962,497, the teachings of which are incorporated herein by reference. Following neutralization, if employed, the substrate is again water rinsed and thereafter is subjected to an activation treatment employing an aqueous acid solution containing a tin-palladium complex of the various types well known in the art. A typical one-step activation treatment is described in U.S. Pat. No. 3,011,920 and U.S. Pat. No. 3,532,518, the substance of both of which patents is incorporated herein by reference.

Following the activation treatment, the activated polymeric substrate is subjected to one or a series of separate cold water rinse treatments whereafter it is subjected to acceleration in an aqueous solution in accordance with methods generally well known in the art. A typical acceleration treatment employing an aqueous accelerating solution containing an aqueous soluble compatible substituted alkyl amine is described in U.S. Pat. No. 4,204,013, the teachings of which are incorporated herein by reference. Following acceleration, the part is cold water rinsed and thereafter is subjected to electroless plating in accordance with the method and composition of the present invention, to apply a conductive continous and adherent metallic plate such as copper over all or selected surface areas thereof. Following the electroless plating step, the part is subjected to one or a plurality of water rinse treatments and is thereafter in condition for conventional electroplating employing normal procedures to apply one or a plurality of overlying metal coatings on the polymeric substrate.

In order to further describe and illustrate the process and composition of the present invention, the following examples are provided. It will be understood that these examples are provided for illustrative purposes and are not intended to be limiting of the scope of the invention as herein described and as set forth in the subjoined claims.

EXAMPLES

The following electroless copper formulation (hereinafter referred to as "Formulation A") is typical of a conventional electroless copper bath of a type to which the present invention may be applied. (Of course, other similar conventional solutions are also suitable herein.)

Ethylenediaminetetraacetic acid tetrasodium salt ($Na_4EDTA$)—40 g/l
Cupric Chloride ($CuCl_2$)—4.2 g/l
Formaldehyde (HCHO)—3 g/l
Sodium Hydroxide (NaOH)—to pH 12.3
Temperature—140° F.
Plating Rate—45 micro inches per 10 minutes
Deposit Appearance—red-pink with grainy patches $Na_4EDTA$ is present as a complexing agent, and is typical of normal production. Of course, other known complexers such as glycine; alanine; aspartic acid; glutamic acid; cystine; nitrilodiacetic acid; triethanolamine; nitrilotriacetic acid; N-Hydroxyethyldiaminetetraacetic acid; N, N, N', N'-Tetrakis (2-Hydroxypropyl) ethylene diamine; diethylenetriamine pentaacetic acid; sodium gluconate; sodium glycoheptonate; sorbitol; mannitol; glycerol; fructose; glucose, Rochelle salts; and mixtures thereof may also be used. Cupric chloride is the source of copper, but other water soluble copper salts such as cupric sulfate, cupric nitrate, cupric acetate, or the like are also suitable for use. Formaldehyde is a reducing agent, although other reducing agents such as formaldehyde precursors or derivatives including paraformaldehyde, trioxane, and glyoxal, as well as sodium borohydride, hydrazine, dimethylamine borane, or the like are also suitable for use. Sodium hydroxide is added as a pH adjuster, although other hydroxides are also suitable to provide similar pH adjustment.

EXAMPLE 1

5 mg/L of ammonium ions, added as ammonium chloride, were added to the above electroless copper formulation (formulation A) in an effort to lower the plating rate. The plating rate was not affected by this amount of ammonium ions. It remained the same as Formulation A (which contained no plating rate controller), i.e. 45 micro inches per 10 minutes.

EXAMPLE 2

The procedure of Example 1 was repeated but the concentration of ammonium ions added to Formulation A was increased to 50 mg/L. At this concentration the ammonium ions functioned as a plating rate controller in that the copper deposition rate was lowered to 40 micro inches per 10 minutes.

EXAMPLE 3

The procedure of Example 1 was repeated but the concentration of ammonium ions added to Formulation A was increased to 275 mg/L. At this concentration the ammonium ions functioned as a plating rate controller in that the copper deposition rate was lowered to 35 micro inches per 10 minutes.

EXAMPLE 4

Additional electroless copper plating solutions comprising copper, a complexing agent, a reducing agent, and a pH adjuster are prepared containing ammonium ions present in an amount so as to be effective as a plating rate controller. Ammonium ions present in an amount of from about 50 to about 600 mg/L are used. When such amounts are used, the plating rate or copper deposition rate will be controlled.

When the foregoing examples are repeated using other conventional electroless copper solutions, similar results will be obtained. Such other electroless copper solutions contain N, N, N', N'-Tetrakis (2-Hydroxypropyl) ethylene diamine as the amine complexing agent instead of $Na_4EDTA$, and/or further contain stabilizers, including organic and inorganic sulfur compounds, colloidal sulfur, very high molecular weight organic polymers, such as gelatin, hydroxy alkyl starches, cellulose ethers, polyamides, polyvinyl alcohol, polyalkylene oxides, and the like.

As evidenced by the above-referenced examples, it should be apparent that the use of the process and composition of the present invention provides both stability and plated plastic of high quality. The plating rate is decreased and effectively controlled thereby giving the plater more control of the resultant deposit.

Among the specific advantages of the present invention, in addition to and in accordance with those described hereinabove, is that a relatively easy to control electroless copper plating system is provided which uses a relatively nontoxic and environmentally acceptable rate controller. In addition, since the plating rate using ammonium ions as a rate controller is a relatively linear function of the amount of ammonium ions, better control of the plating operation is provided. This is unlike electroless copper plating baths using cyanide-type rate controllers in which, as noted hereinabove, the plating rate is not a linear function of the cyanide rate controller.

While it will be apparent that the invention herein disclosed is well calculated to achieve the benefits and advantages as hereinabove set forth, it will be appreciated that the invention is susceptible to modification, variation, and change without departing from the spirit thereof.

What is claimed is:

1. In a process for applying electroless copper plating to a substrate which process includes contacting the substrate with a solution comprising copper, a complexing agent, a reducing agent, and a pH adjuster, the improvement comprising contacting the substrate with said solution wherein said solution further comprises ammonium ions present in an amount of from about 50–600 mg/l, effective to function as a plating rate controller.

2. The process as defined in claim 1 in which said ammonium ions are present in an amount of from about 250 to about 350 mg/L.

3. The process as defined in claim 1 in which said ammonium ions are present in an amount of about 275 mg/L.

4. In a process for applying electroless copper plating to a substrate which process includes contacting the substrate with a solution comprising copper, a complexing agent, a reducing agent, a pH adjuster, and a stabilizer, the improvement comprising contacting the substrate with said solution wherein said solution further comprises ammonium ions present in an amount of from about 50–600 mg/l, effective to function as a plating rate controller.

5. The process as defined in claim 4 in which said ammonium ions are present in an amount of from about 250 to about 350 mg/L.

6. The process as defined in claim 4 in which said ammonium ions are present in an amount of about 275 mg/L.

7. In an electroless copper plating solution comprising copper, a complexing agent, a reducing agent, and a pH adjuster, the improvement comprising said solution further comprising ammonium ions present in an amount of from about 50–600 mg/l, effective to function as a plating rate controller.

8. The solution as defined in claim 7 in which said ammonium ions are present in an amount of from about 250 to about 350 mg/L.

9. The solution as defined in claim 7 in which said ammonium ions are present in an amount of about 275 mg/L.

10. In an electroless copper plating solution comprising copper, a complexing agent, a reducing agent, a pH adjuster, and a stabilizer, the improvement comprising said solution further comprising ammonium ions present in an amount of from about 50–600 mg/l, effective to function as a plating rate controller.

11. The solution as defined in claim 10 in which said ammonium ions are present in an amount of from about 250 to about 350 mg/L.

12. The solution as defined in claim 10 in which said ammonium ions are present in an amount of about 275 mg/L.

* * * * *